US005478358A

United States Patent [19]

Kato

[11] Patent Number: 5,478,358

[45] Date of Patent: Dec. 26, 1995

[54] METHOD FOR IMPROVING AN ANIMAL FIBER

[75] Inventor: Hiroya Kato, Mino, Japan

[73] Assignee: Kato Research Institute Inc., Osaka, Japan

[21] Appl. No.: 230,861

[22] Filed: Apr. 20, 1994

Related U.S. Application Data

[63] Continuation of Ser. No. 923,975, filed as PCT/JP92/00733, Jun. 5, 1992, abandoned.

[30] Foreign Application Priority Data

Dec. 24, 1991 [JP] Japan ..... 3-357281
Jan. 28, 1992 [JP] Japan ..... 3-38747

[51] Int. Cl.[6] ..... D06M 10/00; D06M 10/02

[52] U.S. Cl. ..... 8/115.52; 8/159; 8/137; 8/158; 134/1

[58] Field of Search ..... 8/115.52, 159, 8/139, 137, 147, 158; 134/1; 252/128, 131, 174.25

[56] References Cited

U.S. PATENT DOCUMENTS

| | | | |
|---|---|---|---|
| 2,468,550 | 10/1944 | Fruth | 134/1 |
| 2,904,981 | 9/1959 | Macomson | 8/159 |
| 3,098,370 | 7/1963 | Poole et al. | 8/159 |
| 3,134,990 | 6/1964 | Bodine, Jr. | 8/159 |
| 4,051,046 | 9/1977 | Diehl et al. | 8/137 |
| 4,193,842 | 3/1980 | Rushing | 8/159 |
| 4,512,065 | 4/1985 | Otto | 26/28 |
| 4,575,887 | 3/1986 | Viramontes | 8/159 |
| 4,594,362 | 6/1986 | Smith et al. | 252/91 |

FOREIGN PATENT DOCUMENTS

| | | |
|---|---|---|
| 53-130397 | 11/1978 | Japan . |
| 55-116857 | 9/1980 | Japan . |
| 61-266666 | 11/1986 | Japan . |
| 395986 | 4/1987 | Japan . |
| 2-216258 | 8/1990 | Japan . |

*Primary Examiner*—Prince Willis, Jr.
*Assistant Examiner*—Alan D. Diamond
*Attorney, Agent, or Firm*—Mogan & Finnegan

[57] ABSTRACT

Scales and impurities adhered on an animal fiber can be removed by immersing the animal fiber in an aqueous bath containing inactive inorganic powder and treating it with ultrasonic wave. In the method the animal fiber can be very efficiently improved in the state of stably maintaining the feeling and properties of it. Further, since the method can be carried out with no use of specific chemicals, it is practical with no problem of environmental pollution.

9 Claims, No Drawings

METHOD FOR IMPROVING AN ANIMAL FIBER

This is a continuation of co-pending application Ser. No. 07/923,975, filed as PCT/JP92/00733, Jun. 5, 1992 now abandoned.

TECHNICAL FIELD

The invention relates to a method for improving an animal fiber with ultrasonic treatment.

BACKGROUND OF THE INVENTION

Conventionally, animal fibers such as wool have been widely used because they are high in elasticity and thermal insulation. However, the use of animals fibers have numerous disadvantages such as poor dye penetration, milling caused by interwinding of scales, bad feeling to the skin and the like, due to the presence of scales on the surface.

As a method for improving the milling property, namely shrink-resistant finish, it has been known to remove the scales partially with a chemical treatment. However, this chemical treatment cannot remove the scales completely and has a disadvantage of deteriorating the feeling of the fiber.

Animal fiber (hair) such as wool differs in quality and extent of adhesion of impurities according to the site even in a sheet of fleece. Hence, in order to use animal fiber efficiently, it should be classified into three or four grades. After the classification, the animal fiber is scoured and then subjected to conventional processes such as carding. In general, it has been necessary to apply chemical treatments in the scouring step to remove impurities (grease, sweat, dirt, etc.) adhered on the animal fiber. For example, a complex scouring process is applied by using chlorinated solvents and detergents. However, such a scouring process has problems not only in operation but also in the waste disposal and damage of the fiber.

Recently, environmental pollution problems have become a serious and important issue. The development of a method for carrying out the scouring process of animal hair or a method for improving the milling property without the use of chemicals which cause environmental pollution is needed.

The subject of the invention is to provide a method for physically and efficiently improving the scouring process and the milling property of animal fibers without the use of chemicals which cause environmental pollution.

DISCLOSURE OF THE INVENTION

In the invention, the above-mentioned problems are solved by immersing an animal fiber in an aqueous bath containing an inactive inorganic powder and treating it by an ultrasonic wave.

In such a method according to the invention, inorganic powder which is contained in the water bath is vibrated finely by ultrasonic wave resulting in both the impurities adhered on the fiber and the scales being removed by the vibration. Accordingly, the feeling and properties of the fiber itself can be stably maintained. Further, the extent of scale removal can be set to an optional level.

The inorganic powder used in the invention is not restricted and examples include inactive and stable form. Specific examples include, sintered products of iron, manganese and the like, various ceramics, and minerals such as feldspar and the like may be used. It is preferred to use powders of far-infrared ray-radiating ceramics (e.g., zirconia type, alumina type and titania type ceramics), or zirconium carbonate and the like. Further, it is preferred that the powder is spherical with no angle as far as possible such as material in a ball mill so as not to damage the fiber.

The inorganic powder is preferred to have a diameter smaller than that of the fiber so as not to damage the fiber. Particularly, the powder having a diameter of not substantially larger than 5 microns is preferably used.

The ratio of the inorganic powder to water is not especially restricted, but generally it is preferred to be 5~80:100 by weight, particularly 10~50:100 by weight. When the amount of the inorganic powder is excessive, the inorganic powder is precipitated resulting in an inefficient treatment. Further, the fiber surface may be damaged. On the other hand, when the ratio is too low, the treating speed is lowered.

An example of an ultrasonic treatment for use in the present invention is when the fiber is placed in a bath containing inorganic powder in water and ultrasonic wave is applied to it from upper and lower sides or upper, lower, right and left sides. The frequency is preferably not lower than 18 kilohertz, more preferably about 26 to 38 kilohertz. The upper and lower frequencies may be either same or different. When the frequencies are made different from each other, the gap of waves is eliminated between the wave lengths and the treatment can be performed compactly in high speed.

In the method according to the invention, the extent of removal of the scales of the fiber surface can be set at an optional level by properly selecting the frequency of ultrasonic wave and treating period. Further, in the method of the invention, the fiber can be treated in the state of yarns, felts and woven or knitted fabrics as well as raw fibers to remove optionally scales on the fiber surface in order to improve the dyeing property and shrink-resistance of the fiber. The result is a broad use of animal fibers.

Furthermore, by applying the method of the invention and then immersing the product in a treating composition which is prepared by dispersing far-infrared ray-radiating ceramic fine powder in an aqueous medium containing ethyl alcohol and treating it by ultrasonic wave, the ceramic fine powder can be adsorbed efficiently in the animal fiber product resulting in improved corrosion resistance of the animal fiber product. In this case, as the scales are already removed, the far-infrared ray-radiating ceramic fine powder can be efficiently adsorbed.

Further, when the method of the invention is applied directly to sheared animal fibers, impurities adhered on the fibers can be efficiently removed within a period of ten to some ten minutes. Since no organic solvent nor detergent are used in the treating bath, there is little problem in waste treatment. Additionally, because grease floats on the water bath surface to form a single layer after the treatment, grease (lanolin) can be easily recovered. The inorganic powder used in the treating bath also precipitates and can be recovered for reuse.

Accordingly, in the method, the scouring process can be carried out economically and efficiently. In this case, scales on the fiber surface can be easily removed depending upon the treating time as described above. Accordingly, in the scouring process, it is possible to remove optionally the scales on the fiber surface to improve the dyeing property and the like.

DETAILED DESCRIPTION OF THE PREFERRED EMBODIMENTS

Example 1

30 parts by weight of far-infrared ray-radiating ceramics powder, which mainly contained $SiO_2$, $Al_2O_3$ and MgO and at least 50% of which was fine powder having a diameter of not larger than 5 μm, was mixed with 100 parts by weight of water to prepare a treating bath. In the treating bath, a raw wool (scoured) was placed in a sheet-like form of 1 cm thick and 10 cm square and two ultrasonic generating plates were arranged respectively at a distance of 5 cm above and under the raw wool sheet and ultrasonic wave was applied at a frequency of 26 kilohertz.

The protrusions of the scales on the raw wool surface were removed by a treatment for about 10 minutes and only round bases of the scales remained on the fiber surface. Further continuously treating the fiber for 10 minutes, the fiber surface became smooth with no trace of scales. The Section of the fiber observed by a microphotograph was also totally uniform and no corrosion was observed in the fiber interior.

The product thus prepared was good in feeling and excellent in dyeing property, and allowed uniform dyeing easily. The shrink resistance was also highly improved.

Example 2

40 parts by weight of zirconium carbonate powder was mixed with 100 parts by weight of water to form a treating bath. In the treating bath, a felt of 15 cm square was placed and two ultrasonic wave generating plates were arranged respectively at a distance of 5 cm above and under the felt and ultrasonic wave was applied at a frequency of 38 kilohertz from upper side and a frequency of 26 kilohertz from lower side for 20 minutes.

The product was completely free from scales and no significant unevenness was observed on the fiber surface even by a microphotograph of 2000 magnifications.

Example 3

A bundle of a woolen yarn which was dyed light gray was treated in the same manner as in Example 1.

Resultantly, there was obtained a product, which was bulky and very superior in feeling, without discoloration and with stably maintaining the dyed color. Scales on the fiber surface were substantially removed so that an irregularity could not remarkably observed on the fiber surface even by a microphotograph of 2000 magnifications and the shrink resistance was very improved.

Example 4

A woolen fabric was treated in the, same manner as in Example 1 to obtain a product very improved ,in both of feeling and shrink resistance and useful as a comfortable underwear.

Example 5

A mitten made of a woolen yarn, which had been used for a long time to be changed to a felt-like hard one, was treated in the same manner as in Example 1. Resultantly, the felt-like feeling was removed to change the mitten to that having a very soft feeling.

Example 6

20 parts by weight of a ceramics fine powder, which mainly contained $SiO_2$, $Al_2O_3$ and MgO and at least 50% of which has a diameter of not larger than 5 μm, was mixed with 100 parts by weight of water to prepare a treating bath. Wool fibers (hair) sheared from sheep were immersed in the treating bath and two ultrasonic generators were arranged up and down in the manner as putting the fibers between them at a distance of 5 cm, and ultrasonic wave was applied at a frequency of 26 kilohertz from both of them.

Dry grasses, grease, dirt and the like adhered on the wool fibers were completely removed by a treatment for about 20 minutes and the protrusions of scales on the surface of the wool fibers were removed at the same time and the wool fibers were finished to white cotton form of good feeling. Lanolin could be recovered from the treating bath at the same time.

Example 7

The product prepared in Example 1 was immersed in a treating composition comprising 100 parts by weight of far-infrared ray-radiating ceramic powder, 100 parts by weight of water and 40 parts by weight of ethyl alcohol, and ultrasonic wave of 18 kilohertz was applied for 3 minutes while stirring the treating composition.

The resultant product had an improved dyeing property and was excellent in corrosion-resistance and shrink-resistance. The fine ceramic powder used was same as in Example 1.

Although wool fibers are used as the animal fibers in the above Examples, the same manner can be applied to any fibers of the other animals such as camel, cashmere, rabbit and the like.

Industrial Applicability of the Invention

According to the invention, the scales on the surface of an animal fiber such as wool can be removed with no substantial deterioration of feeling and properties of the fiber to highly improve dyeing property and shrink-resistance of the animal fiber. As the fiber surface becomes smooth, it gives good feeling when touched to the skin to allow its application as a light underwear touching directly to the skin.

Further, the method of the invention can be carried out with no use of specific chemicals and only with use of water and an inactive inorangic powder. Therefore, there is no problem of environmental pollution and a specific time is not required to carry out the waste disposal. Animal fibers can be very economically and efficiently treated. Further, animal fibers can be easily treated in any form of yarns, fabrics, sewed products and the like.

What is claimed is:

1. A method of improving the feeling of an animal fiber, wherein the fiber is immersed in an aqueous bath containing a ceramic powder and water in a weight ratio of 5–80:100 and treated by ultrasonic wave in the aqueous bath, at least 50% of said ceramic powder having a diameter not larger than 5 microns and wherein said bath contains no detergent.

2. The method as defined in claim 1, wherein the aqueous bath contains the ceramic powder and water in the weight ratio of 10–50:100.

3. The method as defined in claim 1, wherein the method is applied to sheared animal fibers.

4. The method as defined in claim 1, wherein the animal fiber is in the form of raw fibers, yarns, felts or woven or knitted fabrics.

5. The method as defined in claim 1, wherein said ceramic powder is a far-infrared ray-radiating ceramic powder.

6. The method as defined in claim 5, wherein the method is applied to remove impurities adhered on the sheared animal fiber.

7. The method as defined in claim 5, wherein the ultrasonic wave is generated by an ultrasonic wave generator generating ultrasonic wave of not lower than 18 kilohertz both under and above the animal fiber in the aqueous bath.

8. The method as defined in claim 5, wherein the animal fiber is in the form of raw fibers, yarns, felts or woven or knitted fabrics.

9. The method as defined in claim 5 wherein the method is applied to remove scales on the animal fiber.

* * * * *